US010220236B2

(12) United States Patent
Oltorik, Jr.

(10) Patent No.: US 10,220,236 B2
(45) Date of Patent: Mar. 5, 2019

(54) PORTABLE RESISTANCE WORKOUT APPARATUSES AND SYSTEMS

(71) Applicant: Rhino Boss LLC, Cincinnati, OH (US)

(72) Inventor: Dennis Ross Oltorik, Jr., Cincinnati, OH (US)

(73) Assignee: Rhino Boss LLC, Cincinnati, OH (US)

( * ) Notice: Subject to any disclaimer, the term of this patent is extended or adjusted under 35 U.S.C. 154(b) by 0 days.

(21) Appl. No.: 14/868,255

(22) Filed: Sep. 28, 2015

(65) Prior Publication Data

US 2016/0144217 A1 May 26, 2016

Related U.S. Application Data

(60) Provisional application No. 62/055,751, filed on Sep. 26, 2014.

(51) Int. Cl.

*A63B 21/00* (2006.01)
*A63B 21/04* (2006.01)
*A63B 21/055* (2006.01)

(52) U.S. Cl.

CPC ..... *A63B 21/0442* (2013.01); *A63B 21/0555* (2013.01); *A63B 21/0557* (2013.01); (Continued)

(58) Field of Classification Search

CPC ..... A63B 21/00058; A63B 21/00061; A63B 21/00065; A63B 21/00069; A63B 21/00072; A63B 21/00076; A63B 21/00178; A63B 21/00181; A63B 21/00185; A63B 21/002; A63B 21/0023; (Continued)

(56) References Cited

U.S. PATENT DOCUMENTS 1,623,670 A * 4/1927 Frankenfeld ..... A63B 21/04 482/123
1,623,671 A * 4/1927 Frankenfeld ..... A63B 21/0552 482/123

(Continued)

OTHER PUBLICATIONS

Portable Journey Gym advertisement, www.groupon.com, 1 pg., http://www.groupon.co.in/deals/shopping/Portable-Journey-Gym/357823 [date retrieved Nov. 19, 2015].

(Continued)

*Primary Examiner* — Gary D Urbiel Goldner
(74) *Attorney, Agent, or Firm* — Ulmer & Berne LLP

(57) ABSTRACT

The present disclosure contemplates a portable strength-training apparatus, system, and method for conducting strength-training exercises using resistance bands. The apparatus of the present disclosure can serve as an anchor while conducting the strength training exercises using the resistance bands. The apparatus and system of the present disclosure can allow for safely performing the strength-training exercises at varying resistance levels while allowing exercises at any angle. The apparatus, system, and method of the present disclosure may allow a user to strength train the user's entire body with the resistance bands. The apparatus and system of the present disclosure may include a base platform with base attachment mechanisms that can be coupled with the resistance bands which are in turn coupled with human interface mechanisms such as grips, wraps, or bars.

19 Claims, 6 Drawing Sheets

(52) U.S. Cl.
CPC ..... *A63B 21/4009* (2015.10); *A63B 21/4013* (2015.10); *A63B 21/4021* (2015.10); *A63B 21/4034* (2015.10); *A63B 21/4035* (2015.10); *A63B 21/4037* (2015.10); *A63B 21/4043* (2015.10); *A63B 2210/50* (2013.01)

(58) Field of Classification Search
CPC ..... A63B 21/02; A63B 21/04; A63B 21/0407; A63B 21/0414; A63B 21/0421; A63B 21/0428; A63B 21/0435; A63B 21/0442; A63B 21/045; A63B 21/0455; A63B 21/055; A63B 21/0552; A63B 21/0555; A63B 21/0557; A63B 21/06; A63B 21/065; A63B 21/068; A63B 21/072; A63B 21/0722; A63B 21/0724; A63B 21/0726; A63B 21/08; A63B 21/15; A63B 21/151; A63B 21/16; A63B 21/1609; A63B 21/1618; A63B 21/1627; A63B 21/1636; A63B 21/1645; A63B 21/1654; A63B 21/1663; A63B 21/1672; A63B 21/1681; A63B 21/169; A63B 21/4001; A63B 21/4009; A63B 21/4011; A63B 21/4013; A63B 21/4015; A63B 21/4017; A63B 21/4019; A63B 21/4021; A63B 21/4023; A63B 21/4025; A63B 21/4027; A63B 21/4033; A63B 21/4034; A63B 21/4035; A63B 21/4037; A63B 21/4043; A63B 23/00; A63B 23/02; A63B 23/0205; A63B 23/0211; A63B 23/0216; A63B 23/0222; A63B 23/0227; A63B 23/035; A63B 23/03516; A63B 23/03525; A63B 23/03533; A63B 23/03541; A63B 23/0355; A63B 23/03575; A63B 23/04; A63B 23/0405; A63B 23/0482; A63B 23/0488; A63B 23/0494; A63B 23/08; A63B 23/12; A63B 23/1209; A63B 23/1245; A63B 23/1281; A63B 23/14; A63B 2023/003; A63B 2023/006; A63B 2023/0411; A63B 26/00; A63B 26/003; A63B 69/0057; A63B 69/0059; A63B 2069/0062; A63B 2208/02; A63B 2208/0204; A63B 2208/0209; A63B 2208/0214; A63B 2208/0219; A63B 2208/0223

See application file for complete search history.

(56) References Cited

U.S. PATENT DOCUMENTS 4,371,162 A * 2/1983 Hartzell ..... A63B 21/04 482/123
4,863,163 A * 9/1989 Wehrell ..... A63B 5/16 482/123
4,968,028 A * 11/1990 Wehrell ..... A63B 5/16 482/124
4,982,958 A * 1/1991 Ullman ..... A63B 21/04 482/123
5,551,934 A * 9/1996 Binette ..... A63B 23/0482 482/123
5,645,510 A * 7/1997 Wilkinson ..... A63B 5/11 482/27
6,299,569 B1 * 10/2001 Rich ..... A63B 21/0004 482/121
7,431,681 B1 * 10/2008 St. Cyr ..... A63B 21/0552 482/121
D590,457 S * 4/2009 Mishan ..... D21/686
7,608,025 B1 * 10/2009 Best ..... A63B 21/0023 482/123
7,739,775 B2 * 6/2010 Shimanski ..... B60P 7/0807 24/265 H
7,951,054 B2 * 5/2011 Snow ..... A63B 21/0552 482/136
7,967,736 B2 * 6/2011 D'Silva ..... A63B 21/055 122/123
D700,792 S * 3/2014 Melton ..... D6/675
8,684,894 B2 * 4/2014 Flynn ..... A63B 21/0004 482/121
8,721,507 B2 * 5/2014 Blancher ..... A63B 21/4033 482/121
9,061,172 B1 * 6/2015 Carrier ..... A63B 23/0458
9,199,110 B2 * 12/2015 Jones ..... A63B 5/16
9,259,606 B2 * 2/2016 Wolan ..... A63B 21/0442
RE46,874 E * 5/2018 D'Silva
2003/0083178 A1 * 5/2003 Gilman ..... A63B 21/055 482/92
2006/0019806 A1 * 1/2006 Mikulski ..... A63B 23/03541 482/121
2006/0199706 A1 * 9/2006 Wehrell ..... A61H 1/0229 482/92
2007/0087920 A1 * 4/2007 Dachraoui ..... A63B 21/0552 482/123
2010/0016132 A1 * 1/2010 Flynn ..... A63B 21/0004 482/122
2010/0323857 A1 * 12/2010 D'Silva ..... A63B 7/02 482/121
2011/0021329 A1 * 1/2011 Dunne ..... A63B 21/0552 482/124
2011/0218077 A1 * 9/2011 Fernandez ..... A63B 26/00 482/8
2011/0251033 A1 * 10/2011 Blancher ..... A63B 21/0442 482/123
2012/0115692 A1 * 5/2012 Bussen ..... A63B 21/0442 482/130
2012/0244997 A1 * 9/2012 Thompson ..... A63B 5/11 482/27
2013/0244835 A1 * 9/2013 Thompson ..... A63B 21/062 482/8
2014/0066262 A1 * 3/2014 Kennedy ..... A63B 71/0036 482/52
2014/0113773 A1 * 4/2014 Marghella ..... A63B 1/00 482/38
2014/0155232 A1 * 6/2014 Wolan ..... A63B 21/0442 482/123
2014/0287894 A1 * 9/2014 Austin ..... A63B 21/0552 482/142

OTHER PUBLICATIONS

VertiMax V8 EX advertisement, www.vertimax.com, 6 pgs., http://www.vertimax.com/product/vertimax-v8ex/ [date retrieved Dec. 12, 2015].

VertiMax Raptor advertisement, www.vertimax.com, 5 pgs., http://www.vertimax.com/product/vertimax-raptor/ [date retrieved Dec. 12, 2015].

X Bar Fitness advertisement, www.xbar.com, 2 pgs., http://www.xbar.com/ [date retrieved Dec. 12, 2015].

* cited by examiner

PORTABLE RESISTANCE WORKOUT APPARATUSES AND SYSTEMS

RELATED APPLICATIONS

This application claims priority under 35 U.S.C. § 119 based on U.S. Provisional Application No. 62/055,751, filed on Sep. 26, 2014. The disclosure of U.S. Provisional Application No. 62/055,751 is incorporated herein by reference.

FIELD OF INVENTION

The present disclosure contemplates an apparatus, system and method for conducting strength training exercises using resistance bands. The present disclosure further contemplates an apparatus, system, and method for conducting strength training exercises where resistance bands may be attached to a portable platform base.

BACKGROUND

Previous apparatuses and systems used for resistance workouts are complicated and unwieldy. Previous apparatuses and systems are also susceptible to limiting constraints, such as the portability of the device, the limited use of a single participant, and the lack of personalization to individual skill level. Still further, previous anchoring apparatuses and systems lack versatility in their integration into an exercise program. For example, some platforms are designed to only incorporate a user's body weight, thereby eliminating its potential use for a heavy lifter, while other platforms have bulky parts or bands that can only be incorporate in a limited number of directions and amount in resistance, thereby eliminating its use for effectiveness.

SUMMARY OF INVENTION

The present disclosure contemplates portable strength-training apparatus and system for conducting strength-training exercises using resistance bands. The apparatus of the present disclosure can serve as an anchor while conducting strength training exercises using resistance bands. The apparatus and system of the present disclosure can allow for safe strength-training exercises at varying resistance levels while allowing exercises at any angle. Resistance band strength-training may reduce the risk of injury compared to traditional weight-based strength-training. The apparatus and system of the present disclosure may allow a user to strength train with resistance bands throughout entire body. The apparatus and system of the present disclosure can be used in home workouts, at the gym, with personal trainers, for professional athletes, for physical therapy, or in the outdoors.

The apparatus and system of the present disclosure may allow for more rapid alteration of the level of resistance than prior resistance workout apparatuses or systems. The apparatus and system of the present disclosure may allow resistance to be quickly altered by manipulating the length of a resistance band that is already in use or by adding or removing resistance bands. The apparatus and system of the present disclosure allow the user to use multiple resistance bands during a workout. The platform base of the present disclosure is designed to allow multiple bands to be securely attached to the platform base. The variability of the apparatus and system of the present disclosure—manipulating the length of the resistance bands or using multiple bands— may allow the user to experience a wide range of resistance from just a few pounds of resistance up to hundreds of pounds of resistance.

In one embodiment the portable strength training apparatus can have a platform base with one or more base attachment mechanisms for attaching resistance bands. The platform base can be portable to allow workouts to be conducted at many locations, such as inside a home, outside in a park, in the office, or at the gym. The platform base can be lightweight so that it can be moved by one person. Base attachment mechanisms on the platform base can allow one or more resistance bands to be attached to the platform base. The one or more resistance band(s) can attach to the base attachment mechanisms on the platform base using a hook or clip or other common coupling mechanism. The resistance bands can also wrap around the base attachment mechanisms or weave through the base attachment mechanisms to shorten the effective length of the resistance band allowing the user to quickly alter the difficulty of the strength training exercise. The base attachment mechanisms on the platform base can extend upward from the top surface of the platform base and be located at various positions throughout the top surface of the platform base or the base attachment mechanisms can be situate in base voids that pass through the platform base. When the base attachment mechanisms extend upward from the top surface of the base platform, one or more securing mechanism can be used to secure resistance bands that are wrapped around or weaved through the base attachment mechanism. The securing mechanism can be elastic bands that squeeze the resistance band and part of the base attachment mechanism together thus ensuring that the resistance band does not unwind or unweave from the base platform during use.

A person using the platform base can stand on the top surface of the platform base when conducting strength-training exercises or the person can stand off of the platform base if the platform base is fixed to an immobile structural component or secured with weights. Standing on the platform base can allow the user to incorporate resistance bands in multiple strength exercises. The portable strength-training apparatus can have a hinge in the platform base that allows the platform base to fold over on to itself for easier portability. The portable strength-training apparatus can have a handle such as a handle which may allow the user to more easily transport the portable strength-training apparatus.

The present disclosure further contemplates a portable strength training system that includes a platform base, resistance bands, base attachment mechanisms, human attachment mechanisms, and coupling mechanisms. The resistance bands may have the coupling mechanisms attached to either end with one end coupling with the base attachment mechanisms and one end coupling to the human attachment mechanism. The human attachment mechanism can be hand grips, wrist straps, ankle straps, a waist strap, or a workout bar. The human attachment mechanisms can allow one or more resistance bands to be attached. The workout bar can also be broken down in to two or more components for transporting with the base platform. Again, the portable strength training system of the present disclosure may allow for safe strength training exercises at varying resistance levels while allowing exercises at any angle. The system of the present disclosure may allow the user to incorporate nearly unlimited levels of resistance to multiple strength-training exercises.

The present disclosure further contemplates a method for strength training that includes the steps of coupling one or more resistance bands to a portable platform base, where the platform base has a top surface, a bottom surface, and a plurality of base attachment mechanisms. In the contemplated method the one or more resistance bands are coupled to the platform base at the base attachment mechanisms via a coupling mechanism. The method of strength training further includes standing on top of the platform base and stretching the one or more resistance bands by applying pressure to one or more of a human interface mechanism. The one or more of the human interface mechanisms may be coupled to the one or more resistance bands which are in turn coupled to the platform base at the base attachment mechanisms.

BRIEF DESCRIPTION OF THE DRAWINGS

The foregoing and other features of the present disclosure will become more fully apparent from the following description, taken in conjunction with the accompanying drawings. Understanding that these drawings depict only several embodiments in accordance with the disclosure and are, therefore, not to be considered limiting of its scope, the disclosure will be described with additional specificity and detail through use of the accompanying drawings.

DETAILED DESCRIPTION

Figure 1:
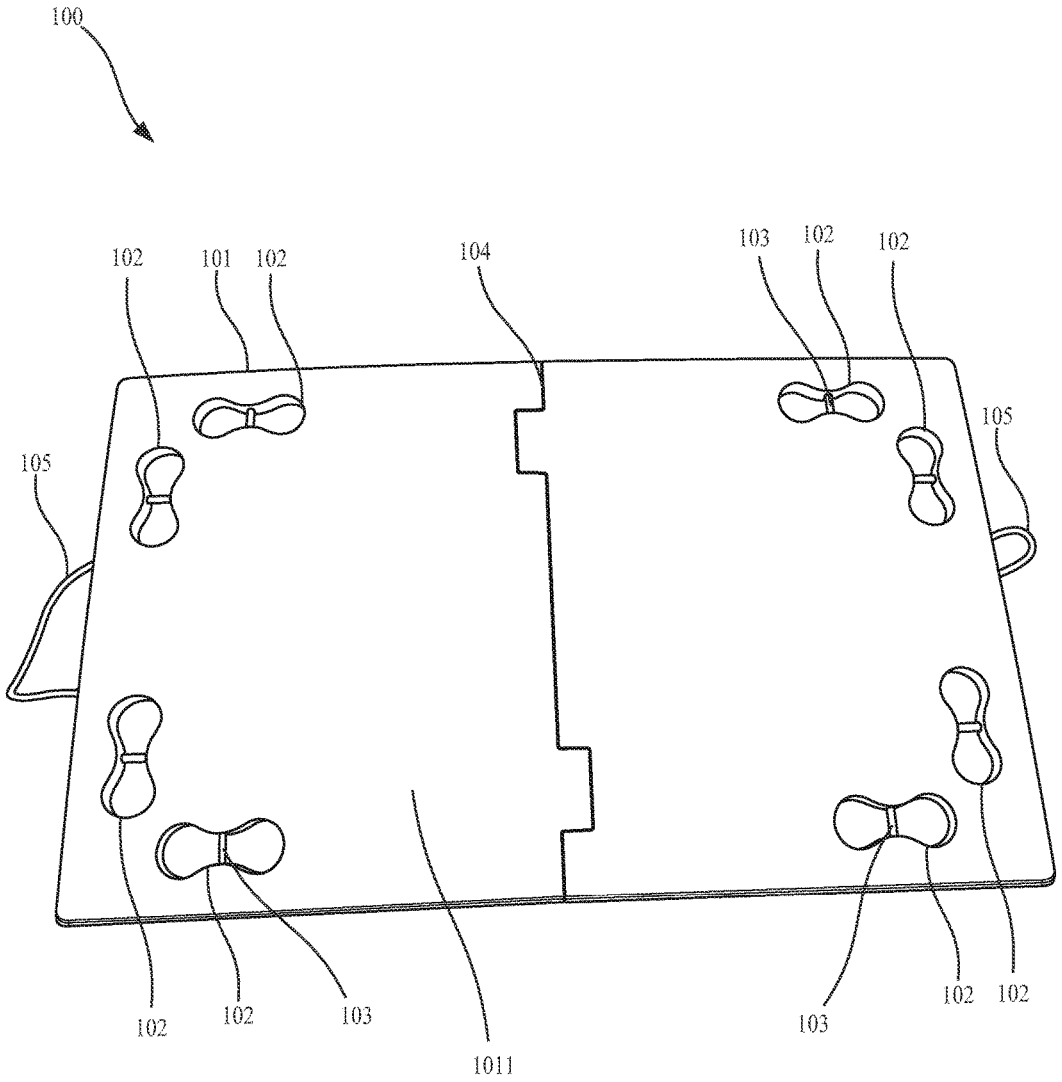
FIG. 1 is a top view of an example portable strength training apparatus with base attachment mechanisms situated in base voids.

In the following detailed description, reference is made to the accompanying drawings, which form a part hereof. In the drawings, similar symbols typically identify similar components, unless context dictates otherwise. The illustrative embodiments described herein are not meant to be limiting. Other embodiments may be utilized, and other changes may be made, without departing from the spirit or scope of the subject matter presented here. It will be readily understood that the aspects of the present disclosure, as generally described herein, and illustrated in the Figures, may be arranged, substituted, combined, and designed in a wide variety of different configurations, all of which are explicitly contemplated and make part of this disclosure.

Figure 2:
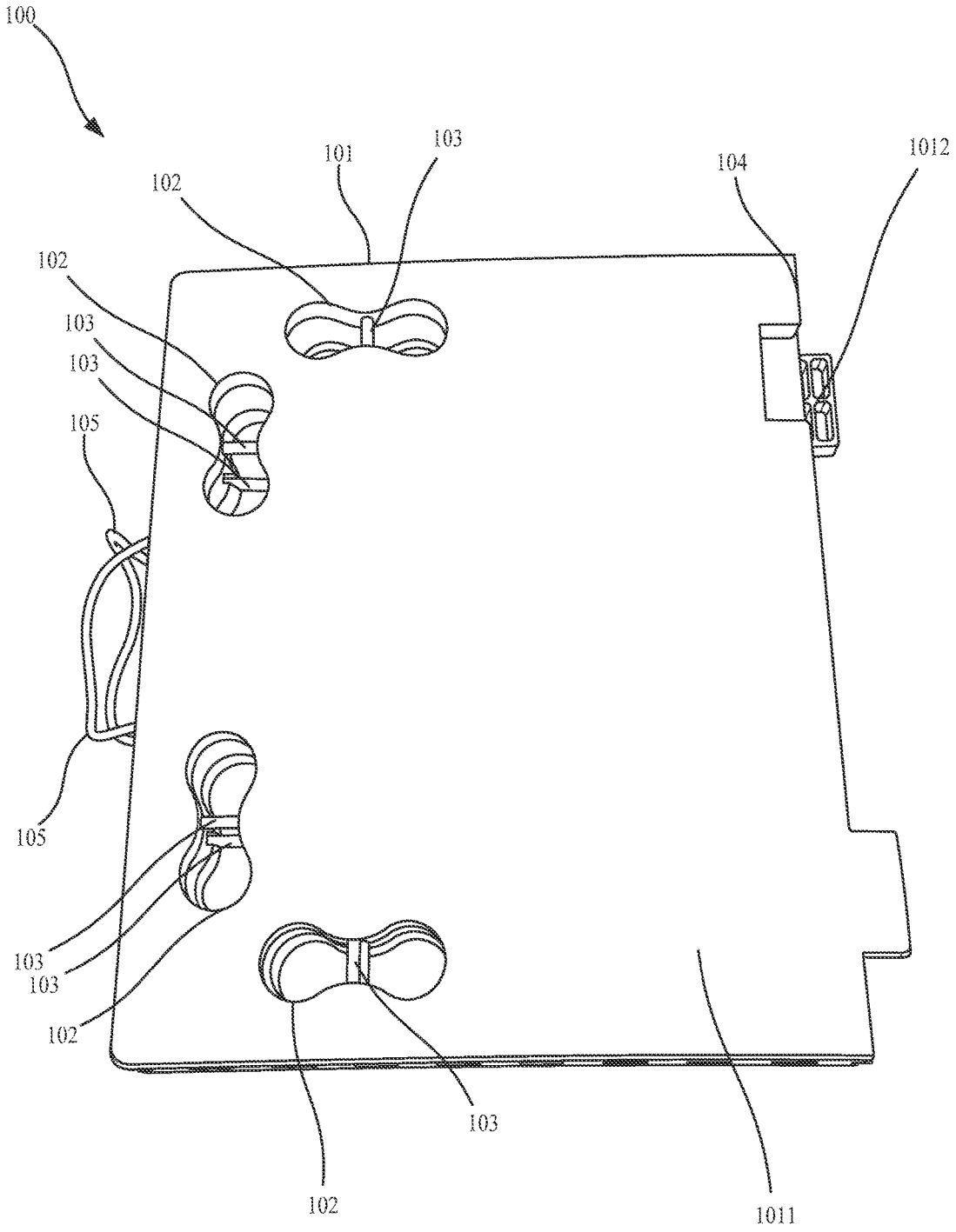
FIG. 2 is a top view of an example portable strength training apparatus with base attachment mechanisms situated in base voids where the platform base is folded along the hinge.

FIG. 1 and FIG. 2 depict an example portable strength training apparatus 100 having a platform base 101 having a top surface 1011, a bottom surface 1012, and a plurality of base attachment mechanisms 103, wherein one or more of the plurality of base attachment mechanisms 103 may be removably coupled with a resistance band. In FIG. 1 the base attachment mechanisms 103 are situated within base voids 103 that pass through the platform base 101. The base attachment mechanisms 103 may be metal, plastic, or another material capable of withstanding the pressure of the resistance bands. The base voids 102 may be placed anywhere throughout the platform base 101 and there may be any number of base voids 102 and corresponding base attachment mechanism 103. The base voids 102 should be large enough to allow coupling between the resistance band and the base attachment mechanism 103. The platform base 101 may be made of plastic, metal, or another material that will not bow or shift when pressure is applied through the resistance bands. The platform base 101 and included base voids 102 and base attachment mechanisms 103 may be formed using common injection molding, stamping, vacuum molding, or welding processes. The platform base 101 may have a lower weight to allow a single person to transport the portable strength training apparatus 100.

Resistance bands 106 (not shown) may be wrapped around one or more of the plurality of base attachment mechanisms 103 before or after the resistance band 106 is coupled to one of the plurality of base attachment mechanism 103. The wrapping and weaving of the resistance band 106 shortens the effective length of the resistance band 106, thus increasing the pressure that must be applied to stretch the resistance band 106. The base voids 102 may allow the resistance bands 106 to wrap around and weave through base attachment mechanisms 103.

The portable strength training apparatus 100 may have a hinge 104. The hinge 104, as depicted in FIG. 2, may allow the platform base 101 to fold over on to itself for easier transportation. The portable strength training apparatus 100 may have a handle 105, such as hand holds, again for easier transportation. The handle 105 may be rope, plastic, metal, or other material capable of sustaining the weight of the portable strength training apparatus 100 during transportation. The handle 105 may be attached to the platform base during molding process, through welding, using an adhesive, or using another method capable of sustaining the weight of the portable strength training apparatus 100 during transportation.

Figure 3:
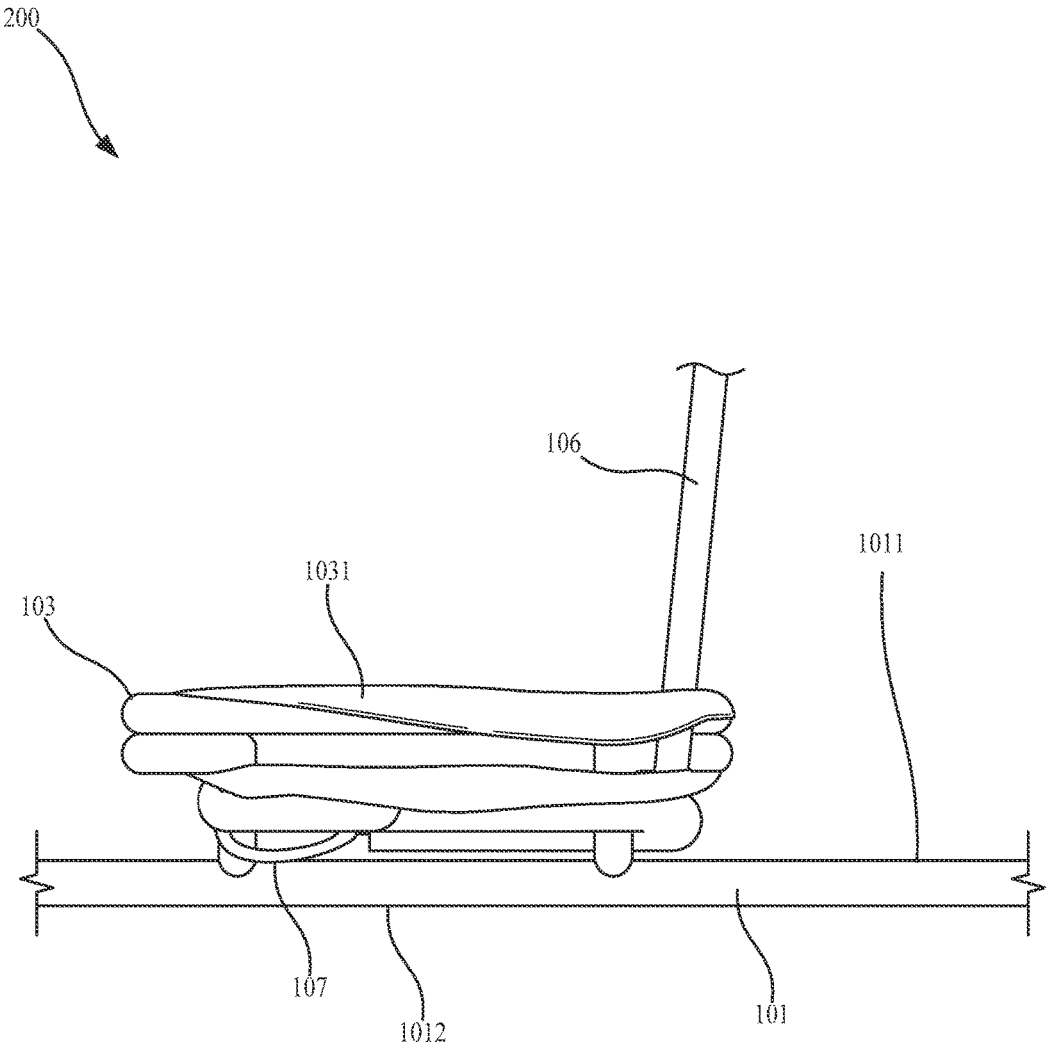
FIG. 3 is a side view of a portion of an example portable strength training system with base attachment mechanisms extending upward from the top surface of the platform base.

FIG. 3 depicts a portion of an example portable strength training system 200 with the plurality of base attachment mechanisms 103 extending upward from the top surface 1011 of the platform base 101 when the bottom surface 1012 of the platform base 101 is in contact with the ground. The coupling mechanism 107 allows a resistance band 106 to be removably coupled to one or more of the plurality of base attachment mechanisms 103. The resistance band 106 may be wrapped around one or more of the plurality of base attachment mechanisms 103 before or after the resistance band 106 is coupled to one of the plurality of base attachment mechanism 103. One or more securing mechanisms 1031 can be used to secure resistance bands 106 that are wrapped around or weaved through the base attachment mechanism 103. The securing mechanism 1031 can be elastic band that squeezes the resistance band 106 and part of the base attachment mechanism 103 together to further lock the resistance band 106 during use so the resistance band 106 does not unwind or unweave from the base platform 101 during use.

Figure 4:
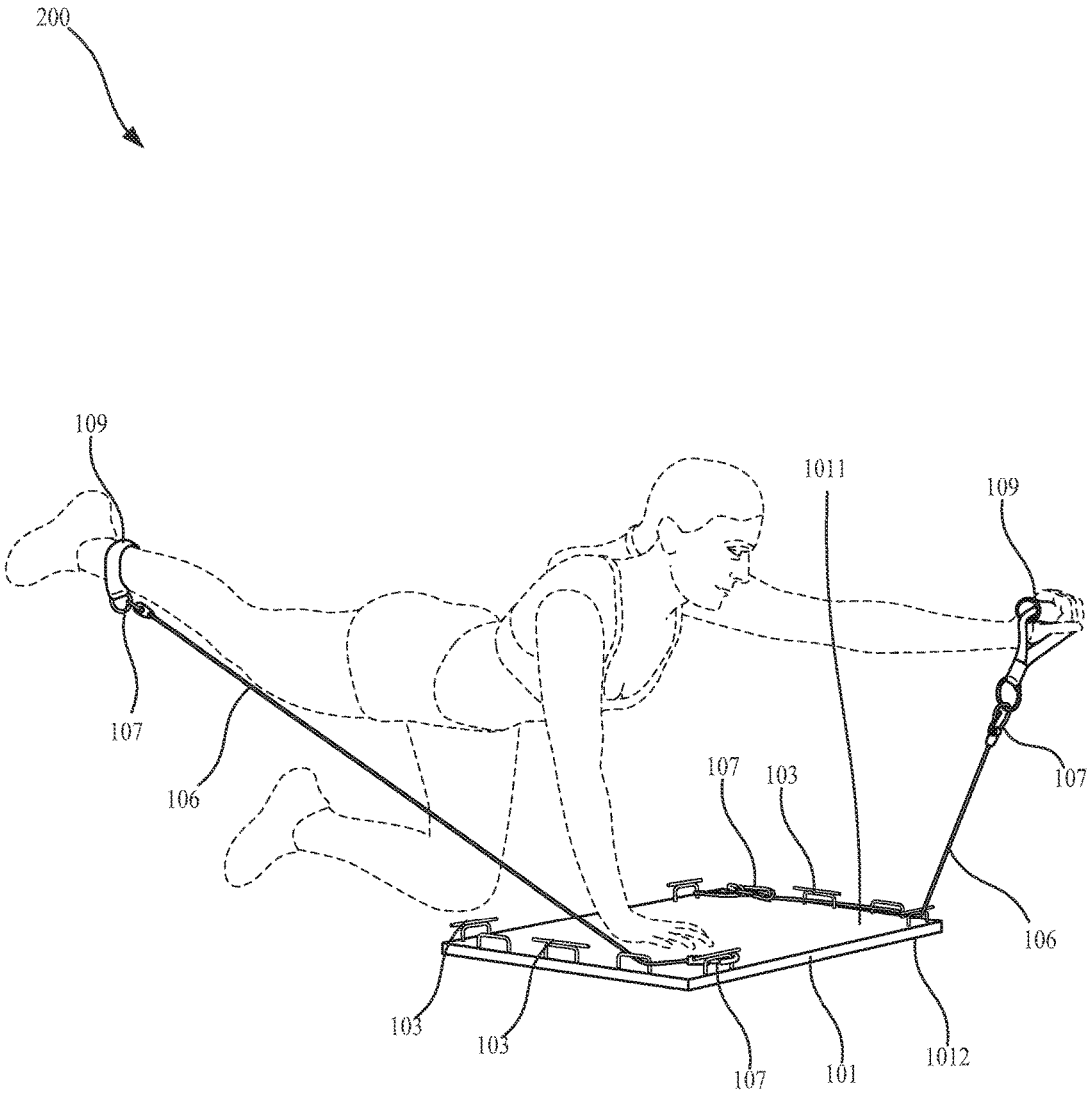
FIG. 4 is a perspective view of an example portable strength training system with base attachment mechanisms extending upward from the top surface of the platform base.
Figure 5:
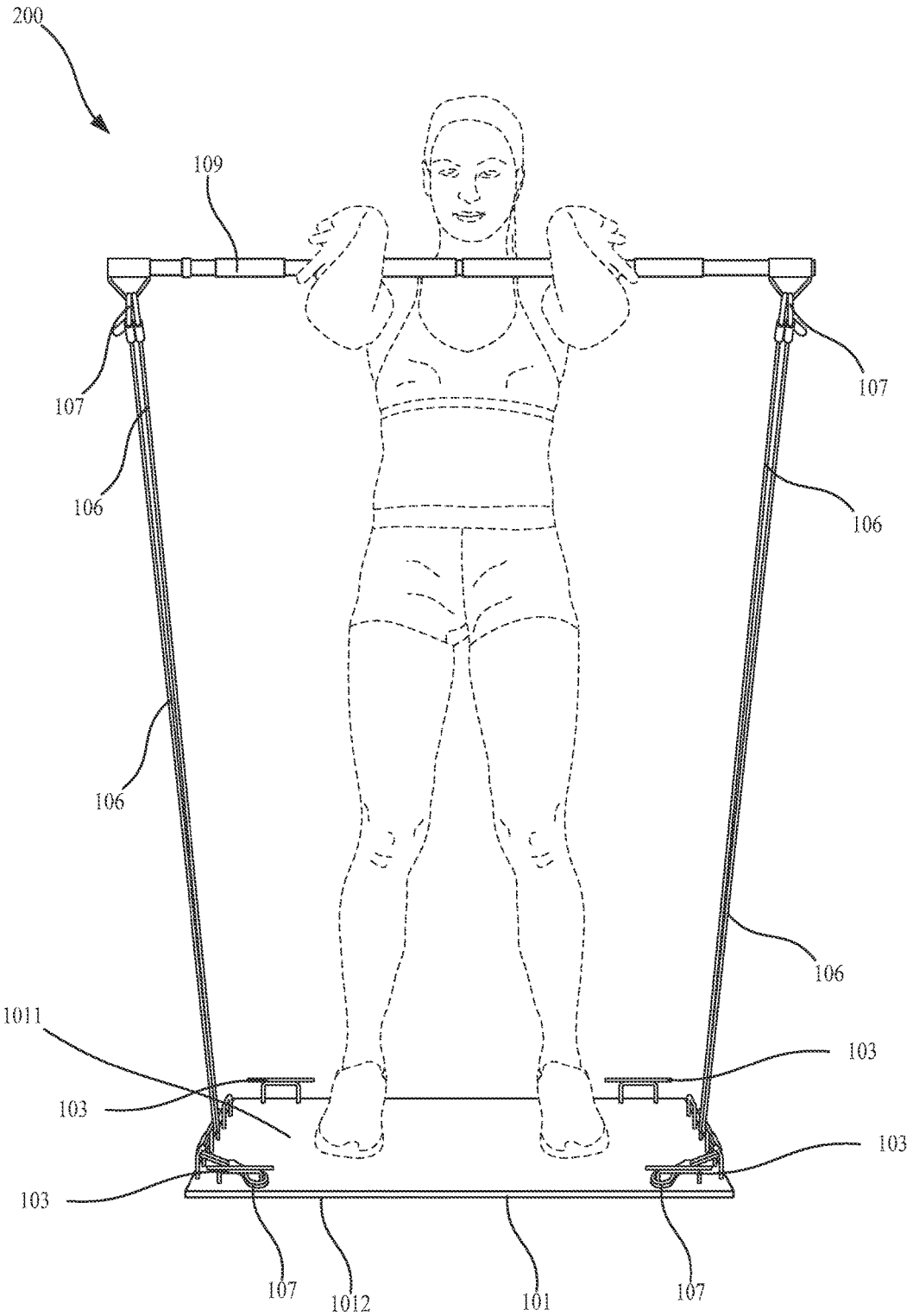
FIG. 5 is a perspective view of an example portable strength training system with base attachment mechanisms extending upward from the top surface of the platform base.

FIG. 4 and FIG. 5 depict example portable strength training systems 200 with the plurality of base attachment mechanisms 103 extending upward from the top surface 1011 of the platform base 101 when the bottom surface 1012 of the platform base 101 is in contact with the ground. Again the coupling mechanism 107 allows a resistance band 106 to be removably coupled to one or more of the plurality of base attachment mechanisms 103. Again, resistance bands 106 may be wrapped around one or more of the plurality of base attachment mechanisms 103 before or after the resistance band 106 is coupled to one of the plurality of base attachment mechanism 103. The wrapping and weaving of the resistance band 106 shortens the effective length of the resistance band 106, thus increasing the pressure that must be applied to stretch the resistance band 106.

The portable strength training systems 200 includes one or more human interface mechanisms 109. The human interface mechanism 109 allow the one or more resistance bands 106 to be stretched by applying pressure to the one or more human interface mechanisms 109. The human interface mechanism can be a hand grip or an ankle strap as shown in FIG. 4 or a workout bar as shown in FIG. 5, or another strap or grip, such as a wrist strap, a waist strap, or foot grip. Any combination of human interface mechanisms 109 can be applied to vary the maneuver and the angle of the maneuver used to stretch the resistance bands 106 in order to strengthen difference muscles and muscle groups. Coupling the resistance bands 106 to base attachment mechanisms 103 at different locations on the base platform 101 can also vary the maneuver and the angle of the maneuver used to stretch the resistance bands 106 in order to strengthen difference muscles and muscle groups. When the human interface mechanism is a workout bar as shown in FIG. 5, it may be disassembled into two or more pieces for easier transport, thus further enhancing the portability of portable strength training systems 200 of the present disclosure. The human interface mechanisms 106 can have a rounded or V-shaped area that allows coupling with multiple resistance bands 106 via the coupling mechanisms 107. The coupling mechanisms 107 may be metal or plastic clips or hooks or another element capable of removably coupling the resistance band 106 to the base attachment mechanisms 103 and the human interface mechanisms 109.

The resistance bands 106 may be of varying length, diameter, and elastic material to allow for varying resistance. The resistance bands 106 may include a protective cover made of cloth or another enclosing material that protects the user of the portable strength training system 200 in case the resistance band 106 breaks during use. As shown in FIG. 5, multiple resistance bands 106 can be used between the same base attachment mechanisms 103 and human interface mechanism 109 to increase the pressure needed to stretch the resistance bands 106. The user of the portable strength training system 200 of the present disclosure can apply downward pressure to the base platform 101 with a hand as shown in FIG. 4 or by standing on the base platform 101 as shown in FIG. 5. The base platform 101 can also be rendered immobile by fixing it to secure structure, applying weights to the base platform 101, by the user applying pressure to the base platform 101 through a body part, or by a spotter applying pressure to the base platform 101 by standing on it or applying pressure through a body part.

Figure 6:
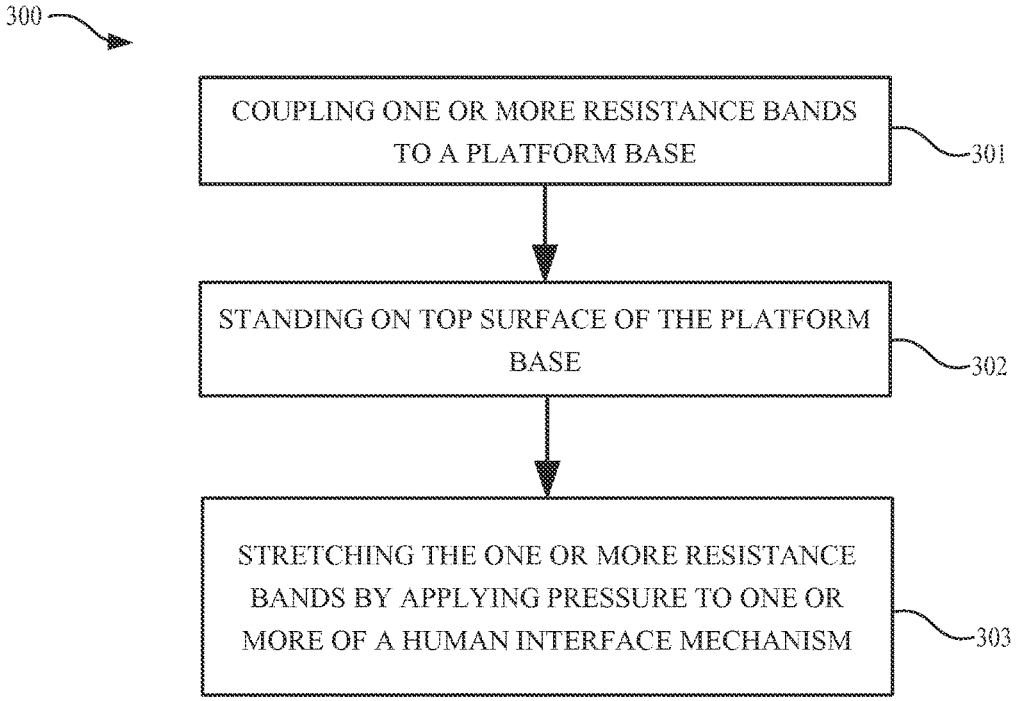
FIG. 6 is a flowchart of an example method for strength training.

FIG. 6 depicts an example of a method for strength training 300 that includes coupling one or more resistance bands to a platform base 301, standing on the top surface of the platform base 302, and stretching one or more resistance bands by applying pressure to one or more human interface mechanisms 303. The method for strength training 300 may use the portable strength training apparatus 100 and portable strength training system 200 described above.

While various aspects and embodiments have been disclosed herein, other aspects and embodiments will be apparent to those skilled in the art. The various aspects and embodiments disclosed herein are for purposes of illustration and are not intended to be limiting.

The sections above may set forth one or more but not all exemplary embodiments and thus are not intended to limit the scope of the present disclosure and the appended claims in any way. Embodiments have been described above with the aid of functional building blocks illustrating the implementation of specified functions and relationships thereof. The boundaries of these functional building blocks have been arbitrarily defined herein for the convenience of the description. Alternate boundaries can be defined so long as the specified functions and relationships thereof are appropriately performed.

The foregoing description of specific embodiments will so fully reveal the general nature of the disclosure that others can, by applying knowledge within the skill of the art, readily modify and/or adapt for various applications such specific embodiments, without undue experimentation, without departing from the general concept of the present disclosure. Therefore, such adaptation and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

Following from the above description summaries, it should be apparent to those of ordinary skill in the art that, while the methods, apparatuses and data structures herein described constitute exemplary embodiments of the current disclosure, it is to be understood that the inventions contained herein are not limited to the above precise embodiments and that changes may be made without departing from the scope of the invention as claimed. Likewise it is to be understood that it is not necessary to meet any or all of the identified advantages or objects of the invention disclosed herein in order to fall within the scope of the inventions, since inherent and/or unforeseen advantages of the current disclosed embodiments may exist even though they may not have been explicitly discussed herein.

What is claimed is:

1. A portable strength training apparatus comprising:

a. a platform base having a top surface and a bottom surface;

b. a cleat extending upward from the top surface, the cleat comprising two horns extending oppositely along a longitudinal portion of the cleat and a connection portion joined directly to the platform base, wherein the longitudinal portion of the cleat is spaced a vertical distance above the top surface, and the connection portion defines a wrapping portion of the cleat between the longitudinal portion and the top surface;

c. a first resistance band having a first end and a second end, and a first condition in which a distance between the first end and second end defines a first effective length dimension;

d. the first resistance band removably coupled to the cleat at the first end in a second condition in which the first resistance band comprises at least one wrap around the wrapping portion of the cleat between the longitudinal portion and the top surface such that the first resistance band defines a second effective length dimension, the second effective length dimension being less than the first effective length dimension; and e. a human interface mechanism coupled to the second end of the first resistance band.

2. The portable strength training apparatus of claim 1, further comprising a securing mechanism attached to the cleat to lock the first resistance band to the cleat.

3. The portable strength training apparatus of claim 1, wherein the human interface mechanism is selected from the group consisting of a hand grip, a wrist strap, an ankle strap, a waist strap, and a workout bar.

4. The portable strength training apparatus of claim 1, wherein the cleat comprises a generally inverted U-shape.

5. The portable strength training apparatus of claim 1, wherein the first resistance band comprises a protective cover material covering the first resistance band between the first end and the second end.

6. The portable strength training apparatus of claim 1, wherein the platform base comprises plastic.

7. A portable strength training apparatus comprising:

a. a platform base having a top surface, and a bottom surface;

b. a cleat extending upward from the top surface, the cleat comprising two horns extending oppositely along a longitudinal portion of the cleat and a connection portion joined directly to the platform base, wherein the longitudinal portion of the cleat is spaced a vertical distance above the top surface, and the connection portion defines a wrapping portion of the cleat between the longitudinal portion and the top surface;

c. a first resistance band having a first end and a second end, and having a first condition in which a distance between the first end and second end defines a first effective length dimension;

d. the first resistance band removably coupled to the cleat at the first end in a second condition in which the first resistance band comprises at least one wrap around the wrapping portion of the cleat between the longitudinal portion and the top surface such that the first resistance band defines a second effective length dimension, the second effective length dimension being less than the first effective length dimension; and e. a human interface mechanism comprising a workout bar, the workout bar comprising two pieces joined at mating ends and coupled to the second end of the first resistance band.

8. The portable strength training apparatus of claim 7, further comprising a securing mechanism to lock the first resistance band to the cleat.

9. The portable strength training apparatus of claim 7, wherein the two pieces of the workout bar are removably joined at the mating ends.

10. The portable strength training apparatus of claim 7, wherein the cleat comprises an inverted U-shape.

11. The portable strength training apparatus of claim 7, wherein the platform base is made of a material selected from the group consisting of plastic and metal.

12. The portable strength training apparatus of claim 7, wherein the first resistance band comprises a protective cover material.

13. A portable strength training apparatus comprising: a. a platform base having a top surface, and a bottom surface, the platform base comprising a material selected from the group consisting of plastic and metal; b. a first, second, and third cleat, each of the first, second and third cleats extending upward from the top surface and comprising two horns extending oppositely along a longitudinal portion of each respective cleat and a connection portion joined directly to the platform base, wherein the longitudinal portion of each respective cleat is spaced a vertical distance above the top surface, and the connection portion defines a wrapping portion of each respective cleat between the longitudinal portion and the top surface; c. a first resistance band having a first end and a second end, and having a first condition in which a distance between the first end and second end defines a first effective length dimension, the first resistance band comprising a protective cover material; d. the first resistance band removably coupled to the first cleat at the first end in a second condition in which the first resistance band comprises at least one wrap around the wrapping portion of the second cleat such that the first resistance band defines a second effective length dimension, the second effective length dimension being less than the first effective length dimension; and e. a human interface mechanism comprising a multi-piece workout bar coupled to the second end of the first resistance band.

14. The portable strength training apparatus of claim 13, further comprising a securing mechanism to lock the first resistance band to the first cleat.

15. The portable strength training apparatus of claim 13, wherein the first resistance band is removably coupled to the first cleat and the multi-piece workout bar by coupling mechanisms, and wherein the coupling mechanisms comprise metal hooks.

16. The portable strength training apparatus of claim 13, wherein each of the first, second, and third cleats comprise an inverted U-shape.

17. The portable strength training apparatus of claim 13, wherein the platform base comprises injection molded plastic.

18. The portable strength training apparatus of claim 13, wherein the multi-piece workout bar comprises at least one V-shaped area for coupling with the second end of the first resistance band.

19. The portable strength training apparatus of claim 13, further comprising a second resistance band, the second resistance band coupled to the third cleat, and wherein the multi-piece workout bar is coupled to the second resistance band.

* * * * *